US011535350B2

(12) United States Patent
Hamad

(10) Patent No.: US 11,535,350 B2
(45) Date of Patent: Dec. 27, 2022

(54) ANTI-SEDIMENTATION SYSTEM FOR MARINE VESSELS

(71) Applicant: Saudi Arabian Oil Company, Dhahran (SA)

(72) Inventor: Maher Ahmad Hamad, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 110 days.

(21) Appl. No.: 16/871,953

(22) Filed: May 11, 2020

(65) Prior Publication Data

US 2021/0347450 A1 Nov. 11, 2021

(51) Int. Cl.

| | |
|---|---|
| ***B63B 59/06*** | (2006.01) |
| ***B63B 59/08*** | (2006.01) |
| ***B08B 3/02*** | (2006.01) |

(52) U.S. Cl.

CPC ..... *B63B 59/06* (2013.01); *B63B 59/08* (2013.01); *B08B 3/02* (2013.01)

(58) Field of Classification Search

None

See application file for complete search history.

(56) References Cited

U.S. PATENT DOCUMENTS

| | | | | |
|---|---|---|---|---|
| 3,773,059 | A * | 11/1973 | Arneson | B63B 59/08 134/123 |
| 6,840,187 | B2 | 1/2005 | Tible | |
| 2006/0157094 | A1 * | 7/2006 | Zeile | B63B 59/10 134/123 |

FOREIGN PATENT DOCUMENTS

| | | |
|---|---|---|
| CN | 85100411 | 7/1986 |
| EP | 0119653 | 9/1984 |
| FR | 2825394 | 12/2002 |
| GB | 2359101 | 8/2001 |
| GB | 2509712 | 7/2014 |
| JP | S4911918 | 3/1974 |

OTHER PUBLICATIONS

PCT International Search Report and Written Opinion in International Appln. No. PCT/US2021/031563, dated Sep. 17, 2021, 13 pages.

* cited by examiner

*Primary Examiner* — Mikhail Kornakov
*Assistant Examiner* — Pradhuman Parihar
(74) *Attorney, Agent, or Firm* — Fish & Richardson P.C.

(57) ABSTRACT

An anti-sedimentation system can implement a method in which a pump pumps seawater to a discharge nozzle positioned under the seawater and facing an under keel clearance of a marine vessel docked at a dock. Sediments are flowed away from the under keel clearance by the discharge nozzle discharging the seawater toward the under keel clearance.

12 Claims, 3 Drawing Sheets

ANTI-SEDIMENTATION SYSTEM FOR MARINE VESSELS

TECHNICAL FIELD

This disclosure relates to marine vessels, specifically, docked marine vessels.

BACKGROUND

A marine vessel is any ship or boat that travels on the sea, ocean or other body of water. Examples of marine vessels include cruise ships that carry passengers or tankers that carry fluids such as hydrocarbons. To load or unload cargo from a marine vessel, the vessel is docked at a wharf. The dock is a structure built along or at an angle from the waterway.

Marine sediment is any deposit of insoluble material, for example, rock and soil particles, that have been transported from land areas to the ocean by wind, ice and rivers. Marine sediment also includes remains of marine organisms, products of submarine volcanism, chemical precipitates from water and other materials that accumulate on the seafloor. When a marine vessel is docked for a duration, marine sediment can accumulate below the vessel.

SUMMARY

This disclosure describes an anti-sedimentation system for marine vessels.

Certain aspects of the subject matter described here can be implemented as a method. A pump pumps seawater to a discharge nozzle positioned under the seawater and facing an under keel clearance of a marine vessel docked at a dock. Sediments are flowed away from the under keel clearance by the discharge nozzle discharging the seawater toward the under keel clearance.

Certain aspects combinable with any of the other aspects include the following features. The pump is operated using diesel power.

Certain aspects combinable with any of the other aspects include the following features. The pump is operated using electric power.

Certain aspects combinable with any of the other aspects include the following features. The pump draws the seawater through an intake member that includes an inlet disposed under the seawater and an outlet fluidically coupled to the pump.

Certain aspects combinable with any of the other aspects include the following features. The intake member includes a portion that is vertical with reference to the sea bed. The portion that is vertical with reference to the sea bed is at least partially disposed under the sea water.

Certain aspects combinable with any of the other aspects include the following features. The seawater drawn through the intake member is flowed through an outlet member that includes an inlet fluidically coupled to the pump and an outlet fluidically coupled to the discharge nozzle.

Certain aspects combinable with any of the other aspects include the following features. The outlet member includes a portion that is horizontal with reference to the sea bed. The discharge nozzle is fluidically coupled to the portion that is horizontal with reference to the sea bed.

Certain aspects combinable with any of the other aspects include the following features. The discharge nozzle is oriented to discharge the seawater horizontally with reference to the sea bed.

Certain aspects combinable with any of the other aspects include the following features. A controller controls flow properties of the seawater pumped by the pump and discharged by the discharge nozzle.

Certain aspects combinable with any of the other aspects include the following features. The flow properties include a flow pressure, a flow volume, and a time of day when the seawater is flowed.

Certain aspects combinable with any of the other aspects include the following features. The time of day is controlled based on sedimentation rates in the under keel clearance and tidal stream characteristics at the time of day.

Certain aspects combinable with any of the other aspects include the following features. The pump, the controller, the intake member and the outlet member are mounted on a skid. The skid is disposed on the dock.

Certain aspects combinable with any of the other aspects include the following features. A docking fender is installed between the dock and the marine vessel. The docking fender creates a space between the dock and the marine vessel. The discharge nozzle is disposed in the space between the dock and the marine vessel.

Certain aspects of the subject matter described here can be implemented as a marine vessel anti-sedimentation system. The system includes a pump configured to flow seawater. The system includes an intake member including an inlet disposed under seawater and an outlet fluidically coupled to the pump. The pump is configured to draw seawater through the intake member. The system includes an outlet member that includes an inlet fluidically coupled to the pump and an outlet configured to be positioned facing an under keel clearance of a marine vessel docked at a dock. The pump is configured to flow the seawater drawn through the intake member through the outlet member. The system includes a discharge nozzle fluidically coupled to the outlet of the outlet member. The discharge nozzle is configured to face the under keel clearance and to discharge the seawater flowed through the outlet member in the under keel clearance of the marine vessel.

Certain aspects combinable with any of the other aspects include the following features. The system includes a controller operatively coupled to the pump. The controller is configured to control flow properties of the seawater pumped by the pump and discharged by the discharge nozzle.

Certain aspects combinable with any of the other aspects include the following features. The flow properties include a flow pressure, a flow volume and a time of day when the seawater is flowed.

Certain aspects combinable with any of the other aspects include the following features. The controller controls the time of day based on sedimentation rates in the under keel clearance and tidal stream characteristics at the time of day.

Certain aspects combinable with any of the other aspects include the following features. The system includes a docking fender configured to be installed between the dock and the marine vessel. The docking fender is configured to create a space between the dock and the sea vessel. The discharge nozzle is disposed in the space between the dock and the sea vessel.

Certain aspects combinable with any of the other aspects include the following features. The discharge nozzle is a first discharge nozzle. The outlet member includes a portion that is horizontal with reference to the sea bed and that is configured to be disposed under the seawater. The system includes multiple discharge nozzles including the first discharge nozzle. Each of the multiple discharge nozzles is attached to the portion that is horizontal.

Certain aspects combinable with any of the other aspects include the following features. The portion that is horizontal is configured to be disposed at a depth that is in the under keel clearance. The multiple discharge nozzles face the under keel clearance. The pump is configured to simultaneously flow the seawater through the multiple discharge nozzles.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

An under keel clearance of a marine vessel is a vertical distance between the deepest underwater point of the vessel's hull and the seabed. The safe under keel clearance enables the vessel to maneuver within an area so that no damage to the house occurs due to impact with the seabed. When a marine vessel is docked at a dock for an extended period of time, sediments may accumulate in the under keel clearance. This disclosure describes implementations of a system that can limit such accumulation on the seabed in the under keel clearance, that is, directly under where the vessels are docked. As described later, the system can operate periodically as a preventive measure to disrupt sediment accumulation directly below marine vessels and to limit the requirement of expensive maintenance dredging operations. Also, the system can be implemented in the presence or absence of a marine vessel on a dock. For example, sediments carried by underwater currents can accumulate near the dock or adjoining areas even in the absence of marine vessels. Programmed periodic operation of the system described here can avoid accumulation of such sediments and limit maintenance dredging as well.

Figure 1:
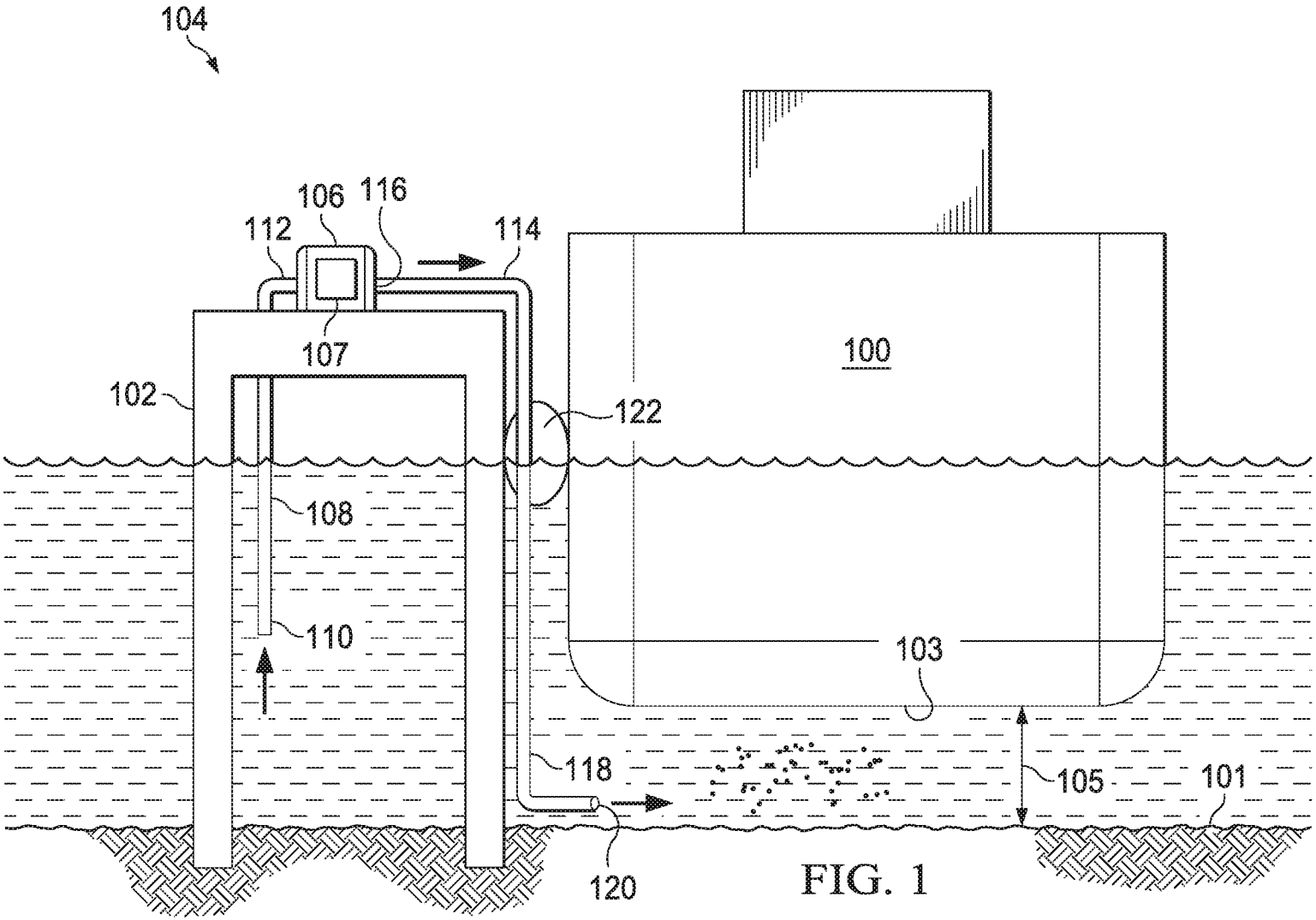
FIG. 1 is a schematic side view of an implementation of an anti-sedimentation system for marine vessels.

FIG. 1 is a schematic side view of an implementation of an anti-sedimentation system for marine vessels. In the schematic, a marine vessel 100 (for example, an oil tanker, a cruise ship, or similar marine vessel) is docked at a dock 102. A distance between the seabed 101 and the bottom most surface 103 of the marine vessel 100 is the under keel clearance 105 for the marine vessel 100. The anti-sedimentation system includes a pump 106 configured to flow seawater, that is, the seawater on which the marine vessel 100 floats. The pump 106 is controlled by a controller 107. For example, the controller 107 is a computer system that controls the flow properties of the seawater pumped by the pump 106, details of which are described later. Other impellers that can draw and discharge seawater can be used as an alternative to or in addition to the pump 106.

The pump 106 is positioned on the surface of the dock 102. The pump 106 is fluidically coupled to an intake member 108 that has an inlet 110 disposed under seawater and an outlet 118 fluidically coupled to an inlet of the pump 106. In some implementations, the intake member 108 is an elongated, tubular member, such as a pipe. The intake member 108 is designed and constructed to flow seawater under operating conditions of the pump 106. For example, the intake member 108 can be constructed of a material that can withstand corrosive effects of seawater. In some implementations, a screen or a filter can be attached to the inlet 110 of the intake member 108 to prevent solid particulates from being drawn into the pump 106. The outlet 112 of the intake member 108 is fluidically coupled to the pump 106.

The pump 106 is fluidically coupled to an outlet member 114 that has an inlet 116 fluidically coupled to an outlet of the pump 106 and an outlet 118 configured to be positioned under the seawater facing the under keel clearance 105 of the marine vessel 100. In some implementations, the outlet member 114 is an elongated, tubular member, such as a pipe. The outlet member 114 is designed and constructed to flow seawater under operating conditions of the pump 106. For example, the outlet member 114 can be constructed of a material that can withstand corrosive effects of seawater. Both the intake member 108 and the outlet member 114 can have the strength to withstand the pressure of the seawater at the depths in which the intake member 108 and the outlet member 114 are disposed.

A discharge nozzle 120 is fluidically coupled to the outlet 118 of the outlet member 114. The discharge nozzle 120 faces the under keel clearance 105. The discharge nozzle 120 discharges the seawater flowed through the outlet member 114 in the under keel clearance 105 of the marine vessel 100. The seawater discharged by the discharge nozzle 120 displaces floating sediments in the under keel clearance 105, thereby preventing the accumulation. The discharge nozzle 120 is capable of moving high volumes of seawater axially through its structure at low differential pressure. The seawater discharged from the discharge nozzle 120 keeps the sediments from settling and forming shoals in the dock.

The intake member 108 has a portion that is vertical with reference to the seabed 101. That is, the portion is substantially perpendicular (for example, with a variance of ±5° from 90°) to the seabed 101 to draw seawater to the pump 106. The vertical portion of the intake member 108 extends from a top surface of the dock 102 or other surface on which the pump 106 is mounted to a predetermined depth in the seawater. In some implementations, the portion of the intake member 108 can be at an angle with reference to the seabed 101. The angle and the predetermined depth to which the portion extends into the seawater depends, in part, on the tides (high tides and low tides). For example, the minimum predetermined depth can be selected such that the inlet of the portion remains submerged even in the lowest of tides when the water level is at its lowest.

Similarly, the outlet member 114 has a portion that is vertical with reference to the seabed 101. That is, the portion is substantially perpendicular to the seabed 101 to discharge seawater toward the discharge nozzle 120. The vertical portion of the outlet member 114 extends from a top surface of the dock 102 or other surface on which the pump 106 is mounted to a depth in the under keel clearance 105. In some implementations, the discharge nozzle 120 can be directly attached to the bottom of the vertical portion of the outlet member 114. In some implementations, the outlet member 114 can include a horizontal portion with an end attached to the bottom of the vertical portion. The discharge nozzle 120 can be attached to the other end of the horizontal portion. The vertical portion of the outlet member 114 can be installed as close as possible to the piles of the dock 102 so that the vertical portion can be run between the dock 102 and the marine vessel 100.

The discharge nozzle 120 is oriented to discharge the seawater flowed through the outlet member horizontally with reference to the seabed 101. In general, the discharge nozzle 120 is designed and constructed to receive the seawater from the outlet member 114 at a first flow rate and to discharge the seawater into the under keel clearance 105 at a second flow rate that is greater than the first flow rate. In some implementations, the discharge nozzle 120 is also designed and constructed to move under water (for example, swing from side to side) to improve sweep coverage of discharged water during motion. In some implementations, the discharge nozzle 120 remains stationary with a design and construction that can provide requisite sweep coverage while stationary. By sweep coverage, it is meant an ability of a discharge nozzle to discharge water equally and evenly from its outlet, spanning a 180° range from left to right and also from top to bottom. In implementations that use multiple discharge nozzles, some can be stationary while others can move under water. For example, the discharge nozzle can be a water jet. In the described arrangement, the seawater is drawn into the inlet 110 of the intake member 108, flows vertically upward towards the pump 106, then horizontally through the pump 106 and into the inlet 116 of the outlet member 114, then vertically downward through the vertical portion of the outlet member 114, and is discharged through the discharge nozzle 120 into the under keel clearance 105.

In some implementations, a docking fender 122 can be disposed between the marine vessel 100 and the dock 102. The docking fender 122 can create a space between the marine vessel 100 and the piles of the dock 102 that are nearest to the marine vessel 100. The docking fender 122 can be an air or water-filled rubber tubing or similar cushion-type material. The docking fender 122 can be made of hard rubber and fixed to walls of the dock. Alternatively or in addition, the docking fender 122 can be a floating type. Multiple docking fenders, all of the same type or of different types, can be used based on the length of the marine vessel. Examples of docking fenders include floating foam fenders, inflatable rubber, pneumatic rubber donut or parallel motion slip types. The vertical portion of the outlet member 114 can be installed in the space created by the docking fender 122 between the dock 102 and the marine vessel 100. In some implementations, the discharge nozzle 120 is also positioned in the space created by the docking fender 122. That is, in such implementations, the discharge nozzle 120 is not positioned directly underneath any portion of the marine vessel 100.

As described earlier, the controller 107 controls the pump 106 to draw seawater through the intake member 108 and to pump the drawn seawater to the outlet member 114 and the discharge nozzle 120. In some implementations, the controller 107 is a computer system that includes one or more processors and a computer-readable medium (for example, a non-transitory, computer-readable medium) storing instructions executable by the one or more processors to perform operations to control the pump 106. For example, the controller 107 can control the flow properties of the seawater pump by the pump 106 and discharged by the discharge nozzle 120. The flow properties can include, for example, a flow pressure, a flow volume, and a time of day when the seawater is flowed. The time of day can be selected based on sedimentation rates in the under keel clearance 105 and tidal stream characteristics throughout the day. In general, the parameters processed by the controller 107 to flow the seawater through the discharge nozzle 120 are selected to have low environmental impact on the seabed 101.

For example, historical tidal stream characteristics of the seawater, such as, information about high tides and low tides at different times of the day, can be stored in the computer-readable medium of the controller 107. Historical sedimentation rates, such as, information about a quantity of sedimentation at different times of the day, can also be stored in the computer-readable medium of the controller 107. Using the stored information, the controller 107 can determine (for example, predict), a quantity of sedimentation in the under keel clearance 105 at a given time of day. If the predicted quantity of sedimentation is greater than a threshold quantity of sedimentation, then the controller 107 can transmit an instruction to turn the pump 106 on, and to discharge seawater through the discharge nozzle 120 to flow the accumulated sedimentation away from the under keel clearance 105. Based on the flow pressure, the flow volume, the flow rate or any combination of them, the controller 107 can determine a quantity of sedimentation that has been flowed away from the under keel clearance 105, and further determine a quantity of sedimentation remaining in the under keel clearance 105. When the quantity of sedimentation remaining in the under keel clearance 105 decreases below the threshold quantity of sedimentation, the controller 107 can transmit an instruction to turn the pump 106 off. In this manner, the controller 107 can continuously monitor sediment accumulation in the under keel clearance 105 and automatically cause the pump 106 to be turned on or off, thereby minimizing pump power consumption and the need for human intervention.

Figure 2:
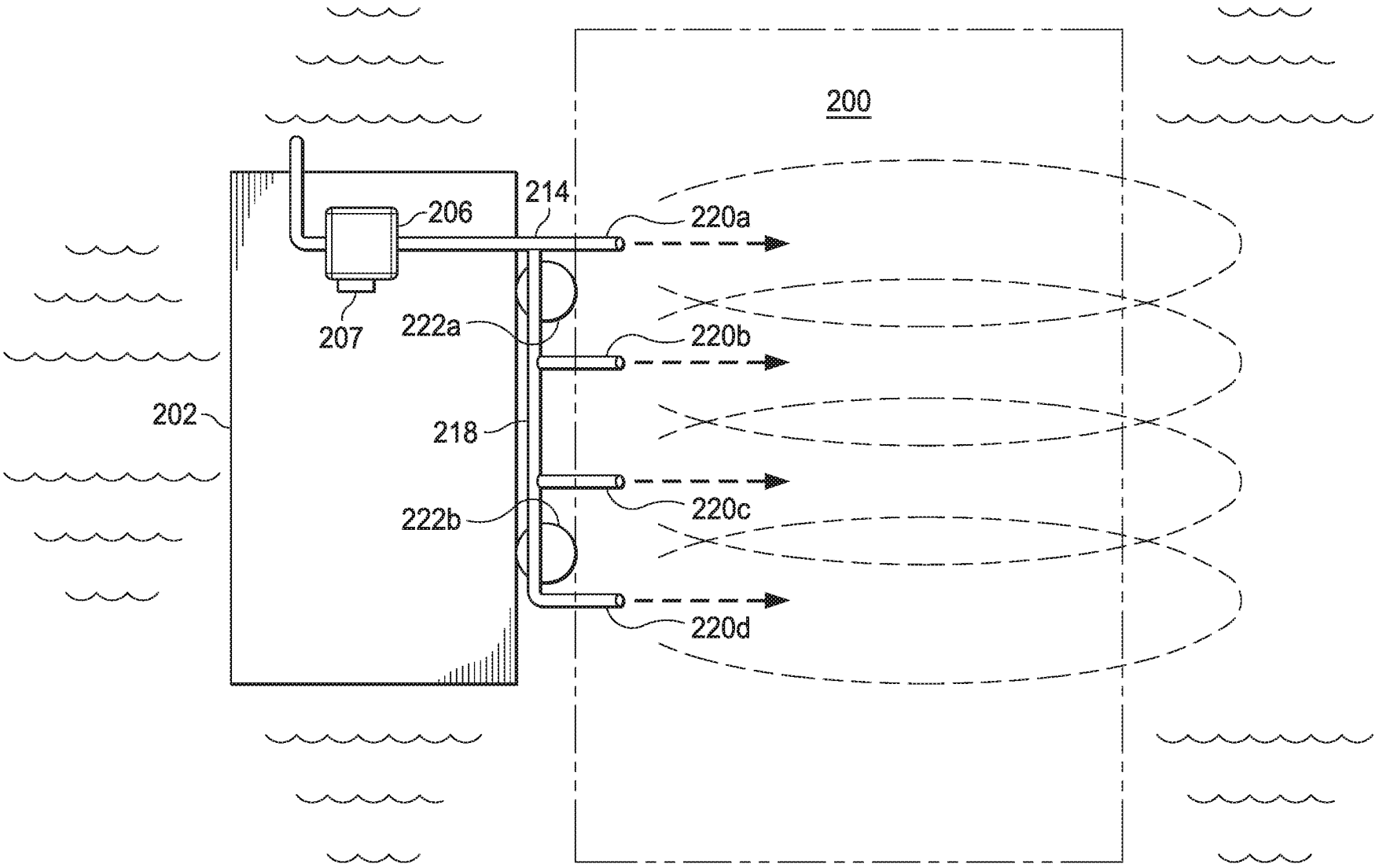
FIG. 2 is a schematic diagram of a top view of an implementation of an anti-sedimentation system for marine vessels.

The anti-sedimentation system described with reference to FIG. 1, included one discharge nozzle 120. FIG. 2 is a schematic diagram of a top view of an implementation of an anti-sedimentation system for marine vessels. The anti-sedimentation system described with reference to FIG. 2 includes multiple discharge nozzles, as described later, but is otherwise substantially similar to the anti-sedimentation system described with reference to FIG. 1. The anti-sedimentation system described with reference to FIG. 2 includes a pump 206 positioned on the surface of a dock 202. The pump 206 is fluidically coupled to an intake member 208 that has an inlet disposed under seawater and an outlet fluidically coupled to an inlet of the pump 206. The pump 206 is fluidically coupled to an outlet member 214 that has an inlet fluidically coupled to an outlet of the pump 206 and an outlet configured to be positioned under the seawater facing the under keel clearance of a marine vessel 200. The pump 206 is controlled by a controller 207 having substantially all capabilities of the controller 107.

The anti-sedimentation system described with reference to FIG. 2 includes multiple discharge nozzles (for example, discharge nozzles 220*a*, 220*b*, 220*c*, 220*d*) distributed along the length of the marine vessel 200, each designed and constructed to receive the seawater from the outlet member 214 at a first flow rate and to discharge the seawater into the under keel clearance 105 at a second flow rate that is greater than the first flow rate. The outlet member 214 includes a horizontal position (that is, horizontal with reference to the sea bed) that spans all or a portion of a length of the marine vessel 200. The length of the horizontal portion is determined by a number of discharge nozzles that are desired. In the schematic of FIG. 2, an end of the horizontal portion is attached to an end of the vertical portion. A discharge nozzle

220*a* is attached to the location at which the ends of the horizontal and vertical portions meet. Remaining discharge nozzles are spaced apart evenly along the length of the horizontal portion with the last discharge nozzle attached to the other end of the horizontal portion. In some implementations, the controller 207 operates each discharge nozzle in a sequence to find the seawater at 180° to provide an overlap and even floor disruption. Alternatively or in addition, the controller 207 operates all discharge nozzles to discharge water simultaneously. In some implementations, the controller 207 can operate batches of discharge nozzles (that is, more than one but less than all the discharge nozzles).

Also, in some implementations, multiple docking fenders (for example, docking fenders 222*a*, 222*b*) can be used to create and maintain a space between the marine vessel 200 and the dock 202. The horizontal portion of the outlet member 214 can be installed in the space. The discharge nozzles can also be positioned in this space so as to not extend underneath the marine vessel. Or, the discharge nozzles can be positioned to extend underneath the marine vessel using additional horizontal tubular members (one per discharge nozzle) attached to the horizontal portion.

In some implementations, the discharge nozzles may be unevenly spaced apart. The end of the vertical portion can be attached to the horizontal portion at a location other than the end (for example, along the mid-point of or nearer to one end than the other of the horizontal portion). Such attachment can provide better balance to the horizontal portion. In some implementations, the outlet member 214 can include a branch such that the discharged seawater is flowed through two pipes instead of one. In such implementations, the horizontal portion of the outlet member 218 can be attached to both pipes, both to improve flow of the seawater and to balance the horizontal portion. Similarly, seawater can be drawn by the pump 206 using more than one intake member. In some implementations, an intake manifold or an outlet manifold (or both) can be used, each including a number of inlets equal to the number of pipes through which seawater is drawn or discharged.

In some implementations, certain components of the anti-sedimentation system can be mounted on the skid. The skid can be a standard skid that can provide the required water flow. A new skid can be constructed and installed when building the dock. Alternatively, the system can be retrofitted to an existing skid on a dock. For example, an existing dock may include a skid on which firewater pump system is installed. Such a skid can be retrofitted by adding few motorized operated valves to provide the required water distribution to create a water stream underneath the marine vessel. The system on such a skid can be powered by the same power source, for example, electrical or diesel power source, using which the firewater pump system is powered. For new dock constructions, the location of the skid (for example, above, below or elsewhere on the dock) depends on the location of the pumps (for example, the firewater pumps). In such new dock constructions, the skid can also be installed in the catwalk under the top of the dock depending on available space.

For example, the pump, the controller, the horizontal portion of the intake member and the horizontal portion of the outlet member can be mounted on the skid. The skid can be operated using diesel power or electricity. The skid and the components mounted on the skid can be transported as a single unit to and from the dock. The skid can be left on the dock for the duration that the marine vessel and can then be transported away from the dock. In this manner, the skid is mobile. During use, the components mounted on the skid are subject to the maintenance including inspection of the pump, the motors, hydraulic fluid condition, cleaning of filters, inspection of pipe insulation and pressure devices.

Figure 3:
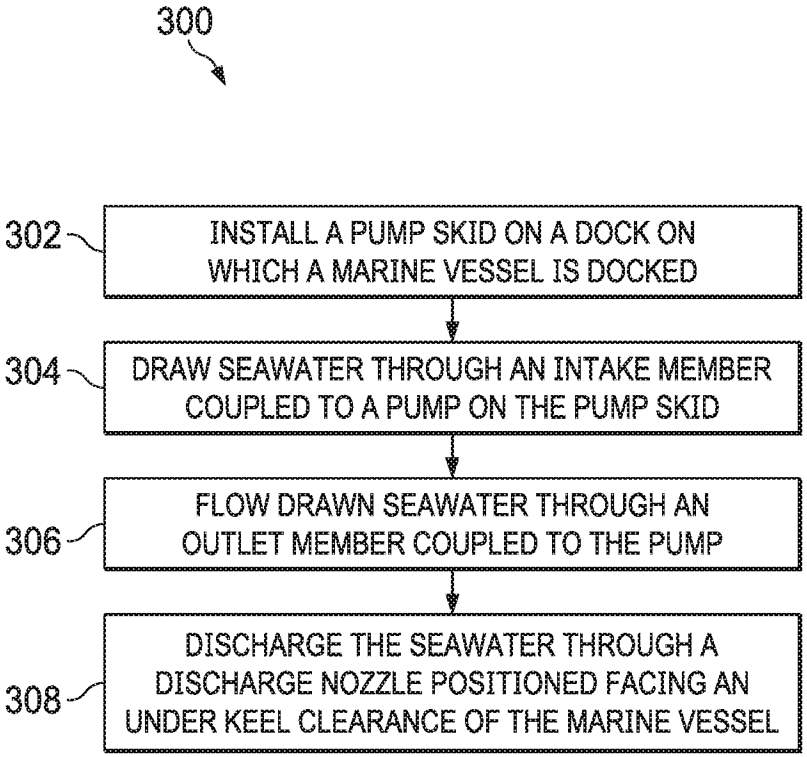
FIG. 3 is a flowchart of an example of a process of preventing sedimentation in the under keel clearance of a marine vessel.

FIG. 3 is a flowchart of an example of a process 300 of preventing sedimentation in the under keel clearance of a marine vessel. Certain aspects of the process 300 can be implemented by a human operator, while other aspects of the process 300 can be implemented by the anti-sedimentation system described in this disclosure. At 302, a pump skid is installed on a dock on which a marine vessel is docked. Certain components of the anti-sedimentation system described in this disclosure are mounted on the pump skid. At 304, seawater is drawn through an intake member coupled to a pump on the pump skid. At 306, the drawn seawater is flowed through an outlet member coupled to the pump. At 308, the seawater is discharged through a discharge nozzle positioned facing an under keel clearance of a marine vessel docked at the dock.

Thus, particular implementations of the subject matter have been described. Other implementations are within the scope of the following claims.

The invention claimed is:

1. A method comprising:

pumping, by a pump, seawater to a discharge nozzle positioned under the seawater and facing an under keel clearance of a marine vessel docked at a dock, wherein the seawater is pumped at a time of day selected based on sedimentation rates in the under keel clearance and tidal stream characteristics at the time of day; and flowing sediments away from the under keel clearance by discharging, by the discharge nozzle, the seawater toward the under keel clearance.

2. The method of claim 1, wherein the pump is operated using diesel power.

3. The method of claim 1, wherein the pump is operated using electric power.

4. The method of claim 1, further comprising drawing, by the pump, the seawater through an intake member comprising an inlet disposed under the seawater and an outlet fluidically coupled to the pump.

5. The method of claim 4, wherein the intake member comprises a portion that is vertical with reference to a sea bed, wherein the portion that is vertical with reference to the sea bed is at least partially disposed under the sea water.

6. The method of claim 4, further comprising flowing the seawater drawn through the intake member through an outlet member comprising an inlet fluidically coupled to the pump and an outlet fluidically coupled to the discharge nozzle.

7. The method of claim 6, wherein the outlet member comprises a portion that is horizontal with reference to a sea bed, wherein the discharge nozzle is fluidly coupled to the portion that is horizontal with reference to the sea bed.

8. The method of claim 7, wherein the discharge nozzle is oriented to discharge the seawater horizontally with reference to the sea bed.

9. The method of claim 6, further comprising controlling, by a controller, flow properties of the seawater pumped by the pump and discharged by the discharge nozzle.

10. The method of claim 9, wherein the flow properties comprise a flow pressure, a flow volume, and the time of day when the seawater is flowed.

11. The method of claim 6, further comprising:

mounting the pump, the controller, the intake member, and the outlet member on a skid; and disposing the skid on the dock.

12. The method of claim 1, further comprising installing a docking fender between the dock and the marine vessel, the docking fender creating a space between the dock and the marine vessel, wherein the discharge nozzle is disposed in the space between the dock and the marine vessel.

* * * * *